US009713878B2

(12) United States Patent
Christie et al.

(10) Patent No.: US 9,713,878 B2
(45) **Date of Patent: *Jul. 25, 2017**

(54) INDICIA FOR RAZOR WITH A ROTATABLE PORTION

(71) Applicant: The Gillette Company LLC, Boston, MA (US)

(72) Inventors: Vanessa Christie, Boston, MA (US); Christopher Ramm, North Attleboro, MA (US); Brian Patrick Watson, Albion, RI (US)

(73) Assignee: The Gillette Company LLC, Boston, MA (US)

( * ) Notice: Subject to any disclaimer, the term of this patent is extended or adjusted under 35 U.S.C. 154(b) by 88 days.

This patent is subject to a terminal disclaimer.

(21) Appl. No.: 14/687,978

(22) Filed: Apr. 16, 2015

(65) Prior Publication Data

US 2015/0217467 A1 Aug. 6, 2015

Related U.S. Application Data

(62) Division of application No. 13/749,888, filed on Jan. 25, 2013, now Pat. No. 9,032,631.

(60) Provisional application No. 61/616,621, filed on Mar. 28, 2012.

(51) Int. Cl.

| | |
|---|---|
| ***B26B 21/40*** | (2006.01) |
| ***B26B 21/52*** | (2006.01) |
| ***B26B 21/22*** | (2006.01) |

(52) U.S. Cl.

CPC ..... *B26B 21/4012* (2013.01); *B26B 21/225* (2013.01); *B26B 21/521* (2013.01)

(58) Field of Classification Search

CPC ... B26B 21/4012; B26B 21/225; B26B 21/52; B26B 21/521

See application file for complete search history.

(56) References Cited

U.S. PATENT DOCUMENTS

| | | | |
|---|---|---|---|
| 3,229,659 | A | 1/1966 | Sciascia |
| 4,152,828 | A | 5/1979 | Lund |

(Continued)

FOREIGN PATENT DOCUMENTS

| | | | | |
|---|---|---|---|---|
| CA | 2443881 | A1 * | 4/2005 | ..... B26B 19/38 |
| GB | 1 143 320 | | 2/1969 | |
| WO | WO 2011/131945 | A1 | 10/2011 | |

*Primary Examiner* — Jennifer Swinney
(74) *Attorney, Agent, or Firm* — Kevin C. Johnson; Steven W. Miller

(57) ABSTRACT

A razor comprises a first component comprising a first indicia on a surface of the first component. The razor also comprises a second component configured to rotate relative to the first component about a first axis of rotation, the second component comprising at least one blade and a second indicia on a surface of the second component, the second component configured to rotate relative to the first component about a second axis of rotation, wherein the second axis of rotation and the first axis of rotation are non-coplanar. The second component is in a preloaded neutral position when at rest such that rotation about the second axis of rotation generates a return torque and wherein the first indicia and the second indicia are in alignment at rest and out of alignment when the second component has been rotated about the first axis of rotation.

14 Claims, 8 Drawing Sheets

(56) References Cited

U.S. PATENT DOCUMENTS

| | | | | |
|---|---|---|---|---|
| 4,617,736 | A * | 10/1986 | McCrary | B44D 3/162 30/169 |
| 5,029,391 | A | 7/1991 | Althaus et al. | |
| 5,033,152 | A | 7/1991 | Althaus | |
| 5,070,614 | A | 12/1991 | Hardin et al. | |
| 5,093,991 | A | 3/1992 | Hendrickson | |
| 5,526,568 | A | 6/1996 | Copelan | |
| 5,535,518 | A | 7/1996 | Althaus | |
| 5,560,106 | A | 10/1996 | Armbruster et al. | |
| 5,678,316 | A | 10/1997 | Althaus et al. | |
| 5,787,593 | A | 8/1998 | Althaus | |
| 5,953,824 | A | 9/1999 | Ferraro et al. | |
| 6,115,924 | A | 9/2000 | Oldroyd | |
| 6,161,288 | A | 12/2000 | Andrews | |
| 6,298,558 | B1 | 10/2001 | Tseng et al. | |
| 6,301,785 | B1 | 10/2001 | Kwiecien et al. | |
| 6,311,400 | B1 | 11/2001 | Hawes et al. | |
| 6,381,857 | B1 | 5/2002 | Oldroyd | |
| 6,442,839 | B1 | 9/2002 | Tseng et al. | |
| 6,449,849 | B1 | 9/2002 | Hackerman | |
| 6,615,498 | B1 | 9/2003 | King et al. | |
| 6,880,253 | B1 | 4/2005 | Gyllerstrom | |
| 6,973,730 | B2 | 12/2005 | Tomassetti et al. | |
| 7,140,116 | B2 | 11/2006 | Coffin | |
| 7,168,173 | B2 | 1/2007 | Worrick, III | |
| 7,197,825 | B2 | 4/2007 | Walker et al. | |
| 7,913,393 | B2 | 3/2011 | Royle et al. | |
| 2008/0034591 | A1* | 2/2008 | Fung | B26B 19/02 30/43.92 |
| 2008/0060201 | A1 | 3/2008 | Kwiecien | |
| 2009/0313837 | A1 | 12/2009 | Winter et al. | |
| 2010/0043242 | A1 | 2/2010 | Stevens | |
| 2010/0083505 | A1 | 4/2010 | Royle et al. | |
| 2010/0313426 | A1 | 12/2010 | Royle | |
| 2011/0035950 | A1 | 2/2011 | Royle | |
| 2011/0067245 | A1 | 3/2011 | Bridges et al. | |
| 2012/0246947 | A1 | 10/2012 | Fang et al. | |
| 2012/0260509 | A1 | 10/2012 | Fang et al. | |
| 2013/0255088 | A1 | 10/2013 | Christie et al. | |
| 2014/0033551 | A1 | 2/2014 | Szczepanowski et al. | |

* cited by examiner

INDICIA FOR RAZOR WITH A ROTATABLE PORTION

FIELD OF THE INVENTION

The invention generally relates to handles for razors, more particularly to handles with a rotatable portion.

BACKGROUND OF THE INVENTION

Recent advances in shaving razors, such as a 5-bladed or 6-bladed razor for wet shaving, may provide for closer, finer, and more comfortable shaving. One factor that may affect the closeness of the shave is the amount of contact for blades on a shaving surface. The larger the surface area that the blades contact then the closer the shave becomes. Current approaches to shaving largely comprise of razors with only a single axis of rotation, for example, about an axis substantially parallel to the blades and substantially perpendicular to the handle (i.e., front-to-back pivoting motion or pitch motion). The curvature of various shaving areas and direction of hair, however, do not simply conform to a single axis of rotation and, thus, a portion of the blades often disengage from the skin or transfer relatively less pressure onto the skin during shaving as they have limited ability to pivot about the single axis. Therefore, blades on such razors may only have limited surface contact with certain shaving areas, such as under the chin, around the jaw line, around the mouth, etc.

Razors with multiple axes of rotation may help in addressing closeness of shaving and in more closely following skin contours of a user. For example, a second axis of rotation for a razor can be an axis substantially perpendicular to the blades and substantially perpendicular to the handle (i.e., side-to-side pivoting motion or yaw motion) or an axis substantially perpendicular to the blades and substantially parallel to the handle (i.e., rotation pivoting motion or roll motion). Examples of various approaches to shaving razors with multiple axes of rotation are described in Canadian Patent No. 1045365; U.S. Pat. Nos. 4,152,828; 5,029,391; 5,033,152; 5,070,614; 5,093,991; 5,526,568; 5,535,518; 5,560,106; 5,787,593; 5,953,824; 6,115,924; 6,311,400; 6,381,857; 6,615,498; 6,880,253; 6,973,730; and 7,140,116; WO2009066218; U.S. Patent Application Publication Nos. 2008/0034591; 2009/0313837; 2010/0043242; 2010/0083505; 2010/0313426; and 2011/0035950; and Japanese Patent Laid Open Publication Nos. H2-34193; H2-52694; and H4-22388. However, to provide another axis of rotation, such as an axis substantially perpendicular to the blades and substantially perpendicular to the handle or an axis substantially perpendicular to the blades and substantially parallel to the handle; typically, additional parts are implemented with increased complexity and movement and include components that may be prone to fatigue, deformation, or set under certain conditions of use and storage. Furthermore, these additional components often require tight tolerances with little room for error. As a result, current approaches introduce complexities, costs, and durability issues for manufacturing, assembling, and using razors with multiple axes of rotation. Some approaches also provide for a second axis of rotation in which the razor can be fixed in position when rotated about the second axis of rotation. Examples of various approaches to shaving razors with multiple axes of rotate on that can be fixed in position are described in Canadian Patent No. 1045365 and U.S. Pat. No. 7,140,116. Such approaches, however, may facilitate uneven balance or uneven load of a blade on the shaving surface.

What is needed, then, is a razor, suitable for wet or dry shaving, with multiple axes of rotation, for example, (1) an axis substantially perpendicular to the blades and substantially perpendicular to the handle and an axis substantially parallel to the blades and substantially perpendicular to the handle or (2) an axis substantially perpendicular to the blades and substantially parallel to the handle and an axis substantially parallel to the blades and substantially perpendicular to the handle. The razor, including powered and manual razors, is preferably simpler, cost-effective, reliable, durable, easier and/or faster to manufacture, and easier and/or faster to assemble with more precision. Such a razor also provides a spring-type mechanism to facilitate rotation about the second axis of rotation such that the mechanism generates a return torque to return the rotating component to the at rest position so as to facilitate a more balanced application or load of a blade on the shaving surface. It is also desirable to provide indicia on the surface of the razor to provide cues to a user, inter alia, that the razor has been rotated about the second axis of rotation and/or how far the razor has been rotated. Such a cue can also allow a user to determine whether the razor has become defective, for example, if the rotating component has taken a set when not in the at rest position.

SUMMARY OF THE INVENTION

In one aspect, the invention relates to a razor comprising a first component comprising a first indicia on a surface of the first component and a second component configured to rotate relative to the first component about a first axis of rotation. The second component comprises at least one blade and a second indicia on a surface of the second component, the second component configured to rotate about a second axis of rotation, wherein the second axis of rotation and the first axis of rotation are non-coplanar. The second component is in a preloaded neutral position when at rest such that rotation about the second axis of rotation generates a return torque and wherein the first indicia and the second indicia are in alignment at rest and out of alignment when the second component has been rotated about the first axis of rotation.

The foregoing aspect can include one or more of the following embodiments. The second axis of rotation can be substantially perpendicular to the first axis of rotation. The first indicia can be disposed near the second indicia. The first indicia can comprise a first apex and the second indicia can comprise a second apex. The first apex can face and align with the second apex when the second component is at rest. At least one of the first indicia and the second indicia further can comprise a gradient leading to at least one of the first apex and the second apex. The return torque can be larger the further away the second component is rotated relative to the first component about the second axis of rotation. Application of the first indicia to the first component can be selected from the group consisting of painting, stamping, heat treating, molding, skiving, gluing, casting, cutting, and combinations thereof. The first indicia can be integrally formed with the first component. Application of the second indicia to the second component can be selected from the group consisting of painting, stamping, heat treating, molding, skiving, gluing, casting, cutting, and combinations thereof. The second indicia can be integrally formed with the second component. At least one of the first indicia and the second indicia can have a shape selected from the group consisting of linear shapes, polygonal shapes, arcuate shapes, and combinations thereof. The first indicia can be a different shape and/or different size than the second indicia. The first component can be a handle. The second component can include a housing for a razor cartridge. The first component can be a handle and an interconnect member.

In another aspect, the invention relates to a razor comprising a first component comprising a first indicia visible from a surface of the first component. A second component is configured to rotate relative to the first component about a first axis of rotation, the second component comprising at least one blade and a second indicia visible from a surface of the second component. The second component is configured to rotate about a second axis of rotation, wherein the second axis of rotation and the first axis of rotation are non-coplanar. The second component is in a preloaded neutral position when at rest such that rotation about the second axis of rotation generates a return torque and wherein the first indicia and the second indicia are in alignment at rest and out of alignment when the second component has been rotated about the first axis of rotation.

The foregoing aspect can include one or more of any of the following embodiments. The first component can form an aperture to show the first indicia disposed underneath. The first indicia can be coupled to the second component. The second component can form an aperture to show the second indicia disposed underneath. The second indicia can be coupled to the first component. The second axis of rotation can be substantially perpendicular to the first axis of rotation. The first indicia can be disposed near the second indicia. The first indicia can comprise a first apex and the second indicia can comprise a second apex. The first apex can face and align with the second apex when the second component is at rest. At least one of the first indicia and the second indicia further can comprise a gradient leading to at least one of the first apex and the second apex. The return torque can be larger the further away the second component is rotated relative to the first component about the second axis of rotation. Application of the first indicia to the first component can be selected from the group consisting of painting, stamping, heat treating, molding, skiving, gluing, casting, cutting, and combinations thereof. The first indicia can be integrally formed with the first component. Application of the second indicia to the second component can be selected from the group consisting of painting, stamping, heat treating, molding, skiving, gluing, casting, cutting, and combinations thereof. The second indicia can be integrally formed with the second component. At least one of the first indicia and the second indicia can have a shape selected from the group consisting of linear shapes, polygonal shapes, arcuate shapes, and combinations thereof. The first indicia can be a different shape and/or different size than the second indicia. The first component can be a handle. The second component can include a housing for a razor cartridge. The first component can be a handle and an interconnect member.

In another aspect, the invention relates to a razor comprising a first component and a second component configured to rotate relative to the first component about a first axis of rotation. The second component comprises at least one blade and an indicia visible from a surface of the second component, the second component configured to rotate about a second axis of rotation, wherein the second axis of rotation and the first axis of rotation are non-coplanar. The second component is in a preloaded neutral position when at rest such that rotation about the second axis of rotation generates a return torque and wherein the indicia is not visible when the second component is at rest and the indicia is visible when the second component has been rotated about the first axis of rotation.

This aspect can include any one or more of the following embodiments. The second component can form an aperture to show the indicia disposed underneath. The indicia can be exposed. The indicia can be coupled to the first component. The second axis of rotation can be substantially perpendicular to the first axis of rotation. The indicia can comprise an apex. The indicia further can comprise a gradient leading to the apex. The return torque can be larger the further away the second component is rotated relative to the first component about the second axis of rotation. Application of the indicia to the first component and/or the second component can be selected from the group consisting of painting, stamping, heat treating, molding, skiving, gluing, casting, cutting, and combinations thereof. The indicia can be integrally formed with the first component and/or the second component. The indicia can have a shape selected from the group consisting of linear shapes, polygonal shapes, arcuate shapes, and combinations thereof. The first component can be a handle. The second component can include a housing for a razor cartridge. The first component can be a handle and an interconnect member.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Except as otherwise noted, the articles "a," "an," and "the" mean "one or more."

"Substantially perpendicular" as defined herein means a first line that intersects a second line, the intersecting line forms an angle of from about 85° to about 90°, or from about 88° to about 90°±0.1°.

"Substantially parallel" as defined herein means a first line that generally sits on a plane as a second line.

Figure 1A:
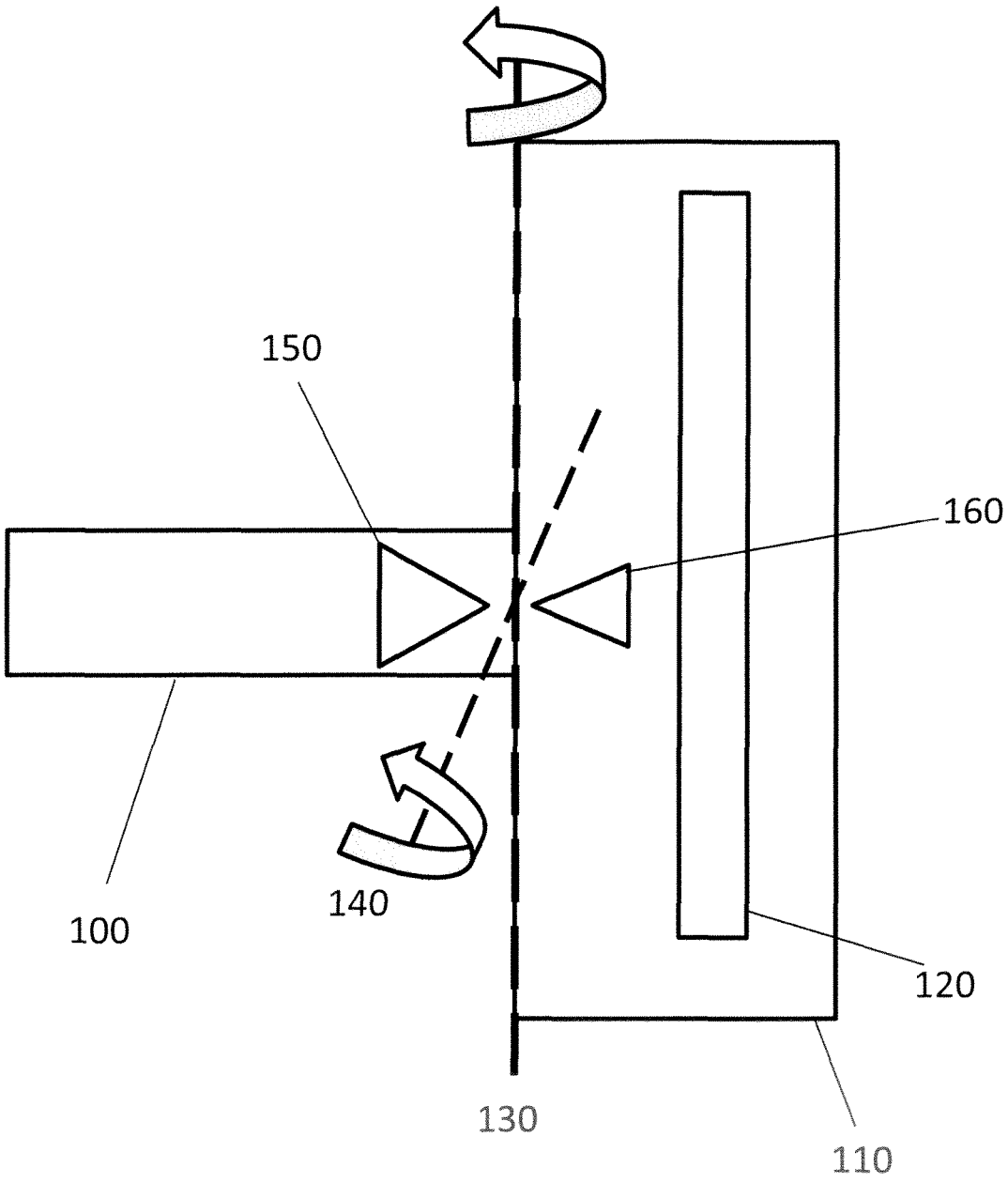
FIGS. 1A and 1B are schematic top views of a shaving razor in accordance with an embodiment of the invention.
Figure 1B:
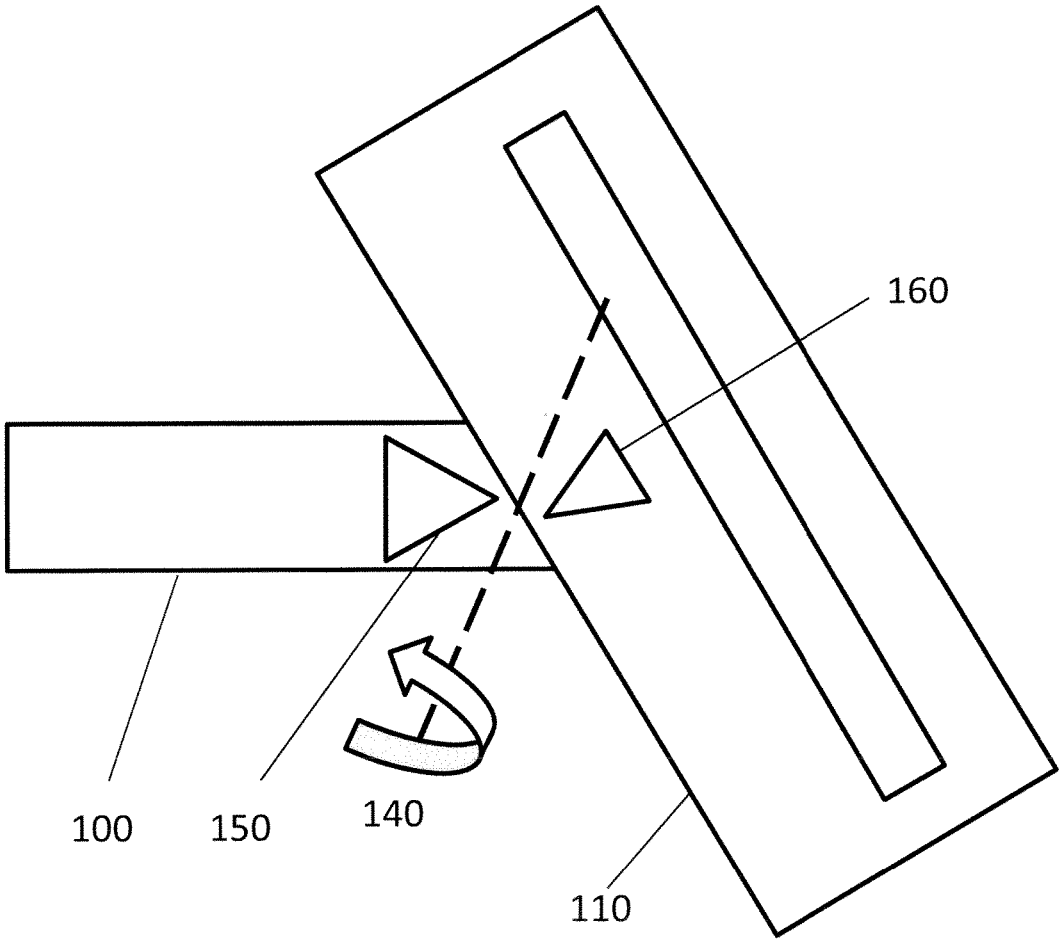

Referring to FIGS. 1A and 1B, a shaving razor of the present invention comprises a first component 100 and a second component 110. In an embodiment, the first component 100 includes a handle and the second component 110 includes a razor cartridge, such as a housing for a razor cartridge. The second component 110 includes at least one blade 120. The second component 110 is configured to rotate about a first axis of rotation 130. In an embodiment, the first axis of rotation 130 is substantially parallel to the at least one blade 120 and substantially perpendicular to a length of the first component 100. The second component 110 is configured to rotate relative to the first component 100 such that the second component 110 rotates about a second axis of rotation 140. In an embodiment, the second axis of rotation 140 is substantially perpendicular to the at least one blade 120 and substantially perpendicular to the length of the first component 100. The first component 100 comprises a first indicia 150, such as one or more indicia, and the second component 110 comprises a second indicia 160, such as one or more indicia. The first indicia 150 can be seen on a surface of the first component 100 and the second indicia 160 can be seen on a surface of the second component 110. In an embodiment, the first indicia 150 and the second indicia 160 are disposed on the first component 110 and the second component 110, respectively, e.g., by painting, printing, stamping, heat treating, skiving, gluing, cutting, and combinations thereof. In an embodiment, the first indicia 150 is integrally formed with the first component 100 and the second indicia 160 is integrally formed with the second component 110, e.g., by molding, casting, cutting, and combinations thereof. The first indicia 150 and the second indicia 160 can take any shape, such as a linear shape, a polygonal shape, an arcuate shape, and combinations thereof. Additionally or alternatively, the first indicia 150 and the second indicia 160 can take a form so as to provide a visual cue to a user, such as with use of colors, decorative shapes or designs, ornate shapes or designs, and so on. Nonlimiting examples of surface indicia are described or shown in U.S. Design patent application Ser. No. 29/400,423, filed Aug. 26, 2011; Ser. No. 29/400,422, filed Aug. 26, 2011; Ser. No. 29/400,421; filed Aug. 26, 2011; Ser. No. 29/393,250, filed Jun. 1, 2011; and Ser. No. 29/411,680, filed Jan. 25, 2012.

In an embodiment, the second component can include a wide scraping surface such as where the shaving razor is used with a depilatory or for skin exfoliation or a blade unit. Where the second component is a razor cartridge the cartridge may also include multiple blades. For example, U.S. Pat. No. 7,168,173 generally describes a Fusion® razor that is commercially available from The Gillette Company and that includes a razor cartridge with multiple blades. Additionally, the razor cartridge may include a guard as well as a shaving aid. A variety of razor cartridges can be used in accordance with the present invention. Nonlimiting examples of suitable razor cartridges, with and without fins, guards, and/or shave aids, include those marketed by The Gillette Company under the Fusion®, Venus® product lines as well as those disclosed in U.S. Pat. Nos. 7,197,825, 6,449,849, 6,442,839, 6,301,785, 6,298,558, and 6,161,288, and U.S. Patent Application Publication No. 2008/0060201.

In a shaving razor of the present invention, the second component 110 rotates relative to the first component 100 via a biased spring mechanism, e.g., a cantilever spring/tail and/or a torsion spring/bar. Nonlimiting examples of biased spring mechanisms used in multi-pivoting shaving razors where one component rotates relative to another component about the second axis of rotation are described in U.S. patent application Ser. No. 13/221,012, filed Aug. 30, 2011, now U.S. Pat. No. 8,745,882; Ser. No. 13/221,025, filed Aug. 30, 2011, now U.S. Pat. No. 8,745,883; 61/471,943, filed Apr. 5, 2011; and 61/476,075, filed Apr. 15, 2011; U.S. Patent Application Publication Nos. 2009/0313837 (now U.S. Pat. No. 8,205,343); 2010/0043242 (now U.S. Pat. No. 8,205,344); and 2011/0035950 (now U.S. Pat. No. 8,474,144); U.S. Pat. No. 7,913,393; and International Patent Application No. PCT/CN2011/000532, filed Mar. 28, 2011. The spring mechanism generates a return torque to return the second component to an at rest position (i.e., when no external forces act on the second component 110) when the second component 110 is rotated about the first axis of rotation 130. In such an embodiment, the at rest position is a preloaded neutral position for the second component 110 relative to the first component 100. To aid in understanding the position of the second component 110 relative to the first component 100, the first indicia 150 and the second indicia 160 are aligned when the shaving razor is in the at rest position. In an embodiment, the first indicia 150 is disposed near the second indicia 160 to aid in providing the visual cue. Additionally or alternatively, the first indicia 150 and the second indicia may each have an apex that face each other and are in alignment when the shaving razor is in the at rest position. Therefore, the apexes are out of alignment and no longer directly face each other or oppose each other when the second component 110 is rotated relative to the first component 100. In an embodiment, at least one of the first indicia 150 and the second indicia 160 have a gradient, such as a slope or incline, in which the gradient leads to or culminates to the respective apex. The gradient provides a visual cue to a user of how far the second component 110 has been rotated relative to the first component 100. In an embodiment, the gradient can provide an indication that the return torque will be larger the farther away the second component 110 has been rotated from the at rest position relative to the first component 110, e.g., about the second axis of rotation 140.

Figure 2A:
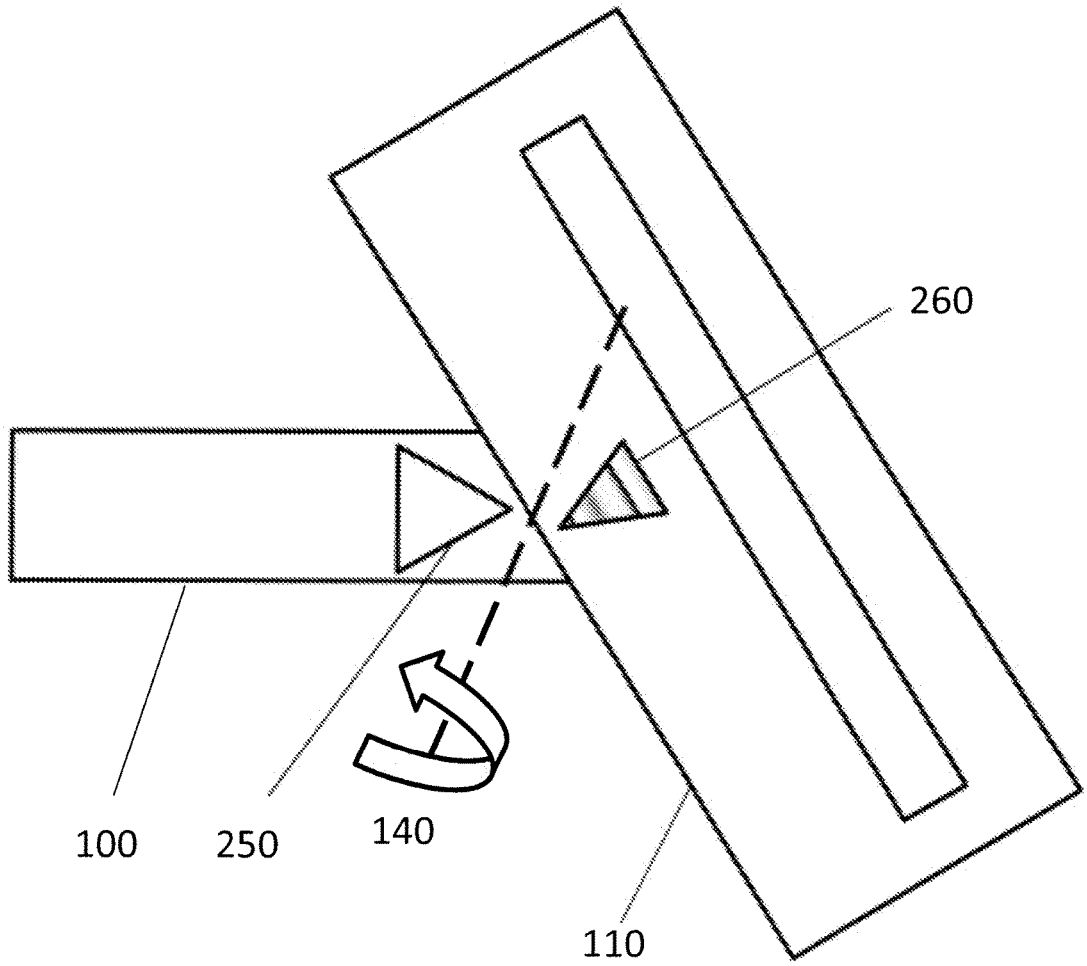
FIGS. 2A and 2B are schematic top views of a shaving razor in accordance with another embodiment of the invention.
Figure 2B:
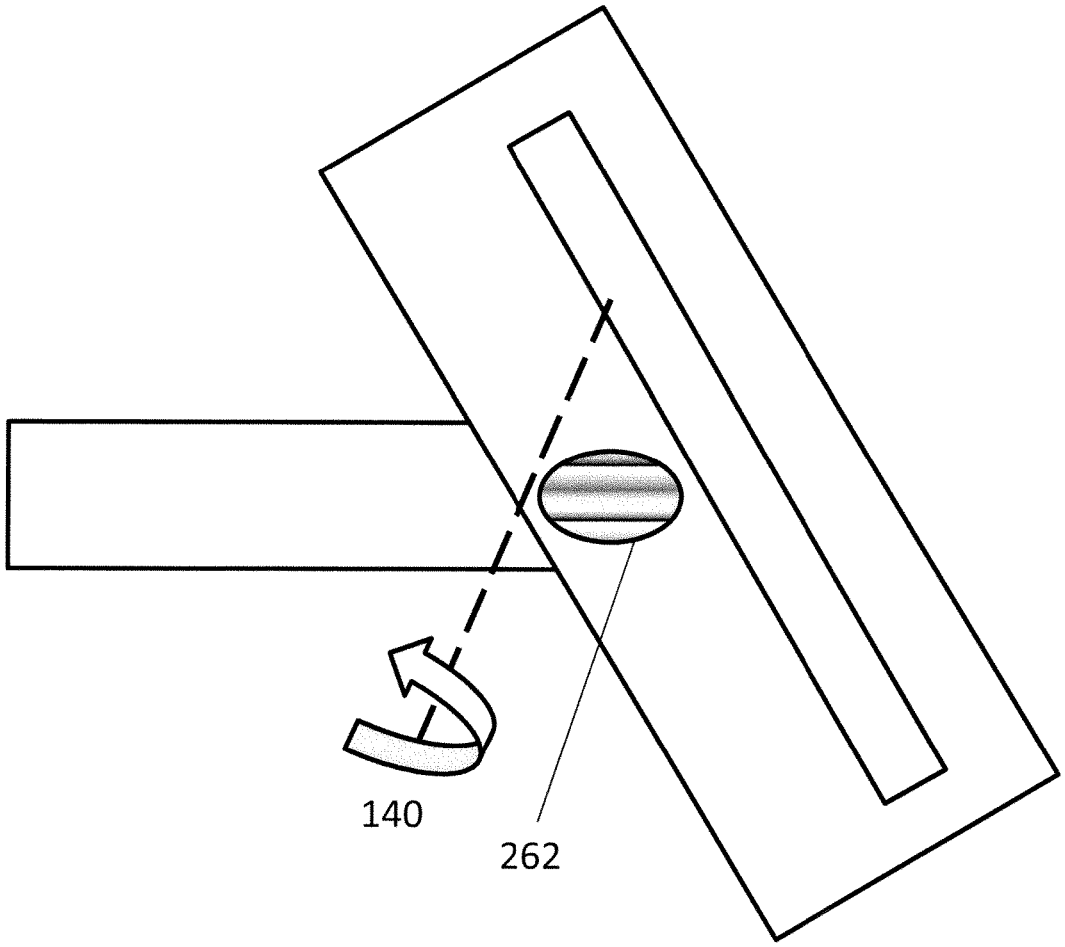

Referring now to FIGS. 2A and 2B, the second indicia 260 can be disposed underneath a surface of the second component 110. In an embodiment, the second component 110 includes a window. When the second component 110 is rotated far enough, the second indicia 260 can be visible through the window to allow a user to understand that the second component 110 has been rotated far enough. In an example, the second indicia 260 can be partially visible where the second component 110 has been only partially rotated relative to the first component 100 and the second indicia can be not visible when the second component 110 is at rest. Additionally or alternatively, the second indicia 260 can be a part of the first component 100 and be seen on a part of the second component 110 when the second component 110 is rotated relative to the first component 100. Additionally or alternatively, the first indicia 250 can be similarly disposed underneath a surface of the first component 100 in the same manner. In an alternative embodiment, as shown, where the second indicia 262 is visible upon rotation of the second component 110 relative to the first component 100, there need not be a first indicia, or vice versa. Additionally or alternatively, the second indicia 262 is not visible when the second component 110 is at rest relative to the first component 100.

Figure 3:
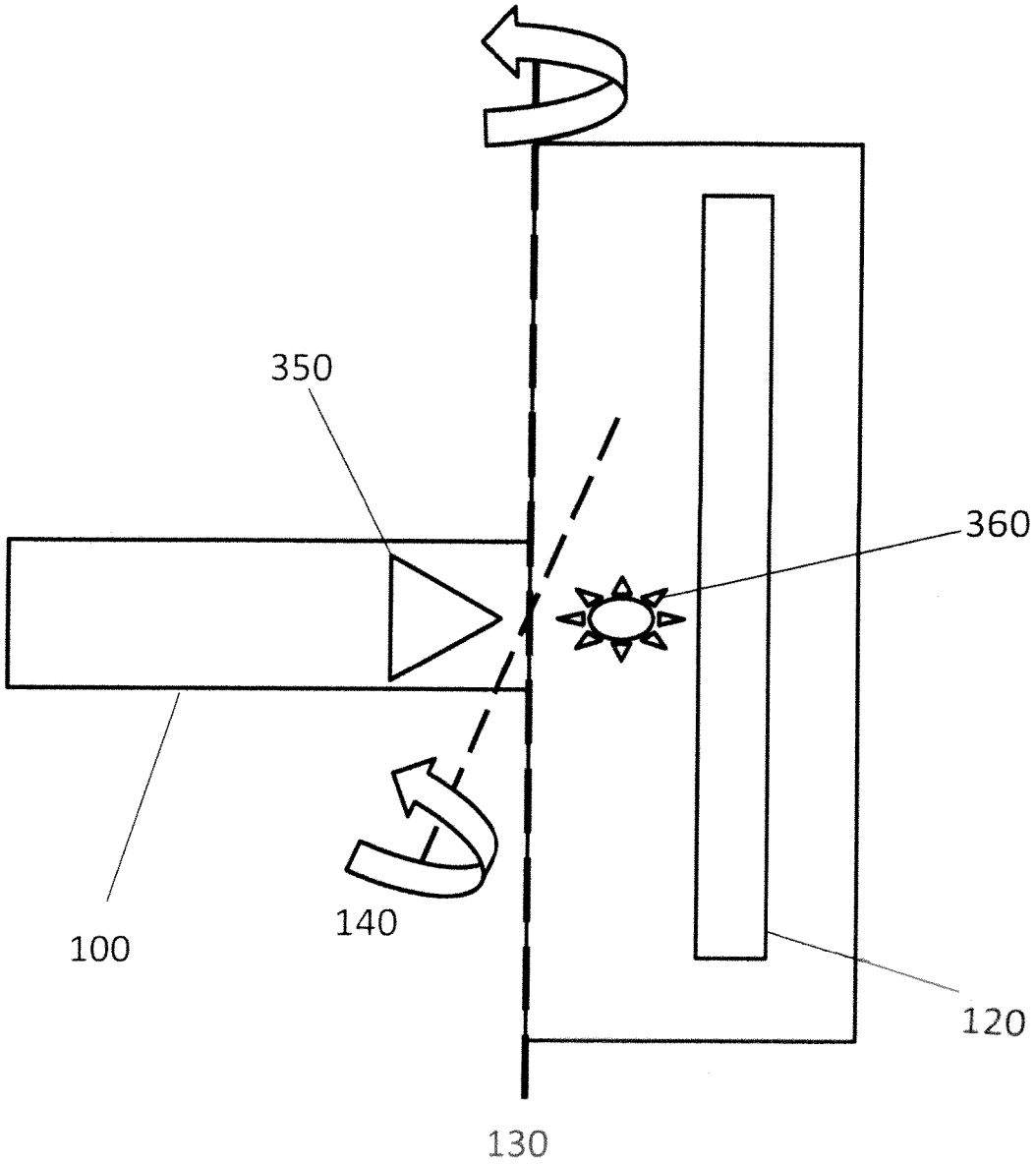
FIG. 3 is a schematic top view of a shaving razor according to another embodiment of the invention.

As shown in FIG. 3, in an embodiment, the second indicia 360 can be a different shape, form, size, or visual cue than the first indicia 350. Additionally or alternatively, the second indicia 360 can still have a visual cue to compare to the first indicia 350 that can show alignment of the second component relative to the first component 100 when in the at rest position. For example, a portion of the second indicia 360 can still show an apex and/or a gradient to compare to an apex and/or a gradient of the first indicia 350.

In various embodiments, at least one of the first indicia and the second indicia can be at least one projection and/or at least one recess or channel. Additionally or alternatively, the at least one projection and/or the at least one recess or channel can traverse partially the respective first component or second component or the at least one projection and/or the at least one recess or channel traverses the entire respective first component or second component. For example, the at least one projection and/or the at least one recess can be shaped as a wave, e.g., a curvy wave, around the respective first component or second component. In another embodiment, at least one of the first indicia and the second indicia can be embossed on the respective first component and second component. In an alternative embodiment, at least one of the first component and the second component can include a gauge or a dial to provide a visual cue to a user how far out of the at rest position the second component has rotated. Where one indicia has a gauge or a dial, the other indicia may, optionally, include a reference surface indicia (e.g., a line) that can be viewed relative to the gauge. In an embodiment, at least one of the first indicia and the second indicia has a portion formed of a soft plastic, such as a thermoplastic elastomer. The soft plastic can deform or compress (e.g., bellows) when the second component has been rotated away from the at rest position to also provide a visual cue as to the position of the second component relative to the first component. In an alternative embodiment, a portion of at least one of the first indicia and the second indicia is partially exposed (e.g., such as exposure of a color) so that rotation of the second component relative to the first component away from the at rest position can expose more or expose less of the portion of the at least one of the first indicia and the second indicia. For example, where a portion of the second indicia is partially exposed in the at rest position and the second indicia becomes less exposed or covered when the second component is rotated from the at rest position, the second indicia can be covered by the first indicia. Additionally or alternatively, the second indicia is coupled to the first component and the second component rotates relative to the second indicia and the first component such that the second component will cover the second indicia when the second component is rotated from the at rest position.

Figure 4:
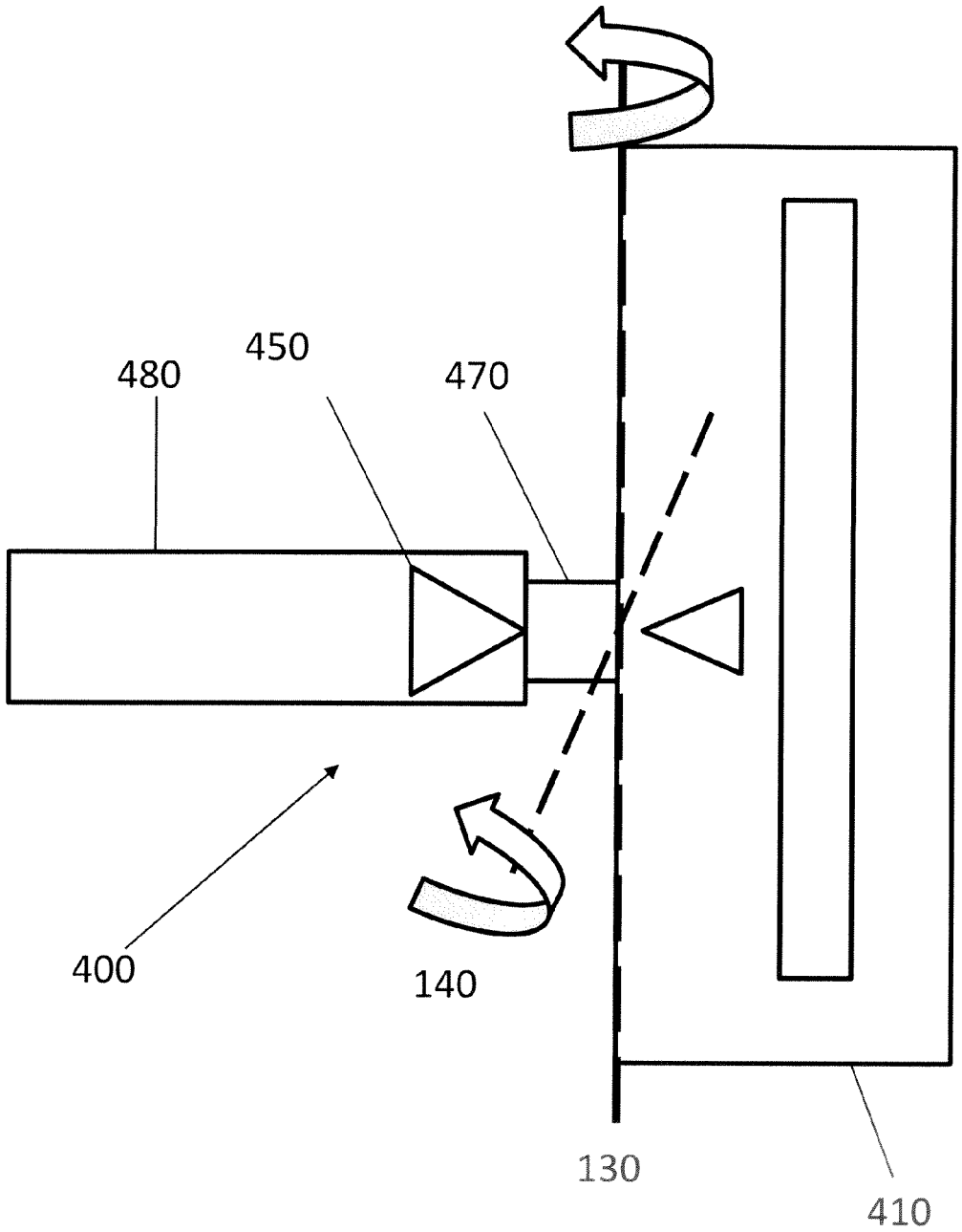
FIG. 4 is a schematic top view of a shaving razor in accordance with another embodiment of the invention.

Referring now to FIG. 4, the first component 400 includes a handle and an interconnect member 470. Nonlimiting examples of an interconnect member for a shaving razor are described in U.S. Pat. Nos. 5,813,293; 5,918,369; 6,029,354; 5,787,586; 5,956,851; and 5,784,790. In an embodiment, the interconnect member 470 is coupled to a second component 410 such that the second component rotates about the first axis of rotation 130. The first indicia 450 can be disposed on a handle 480 and/or the interconnect member 470. In an alternative embodiment, a window for viewing a first indicia 450 can be disposed on or in a handle 480 and/or the interconnect member 470.

Figure 5A:
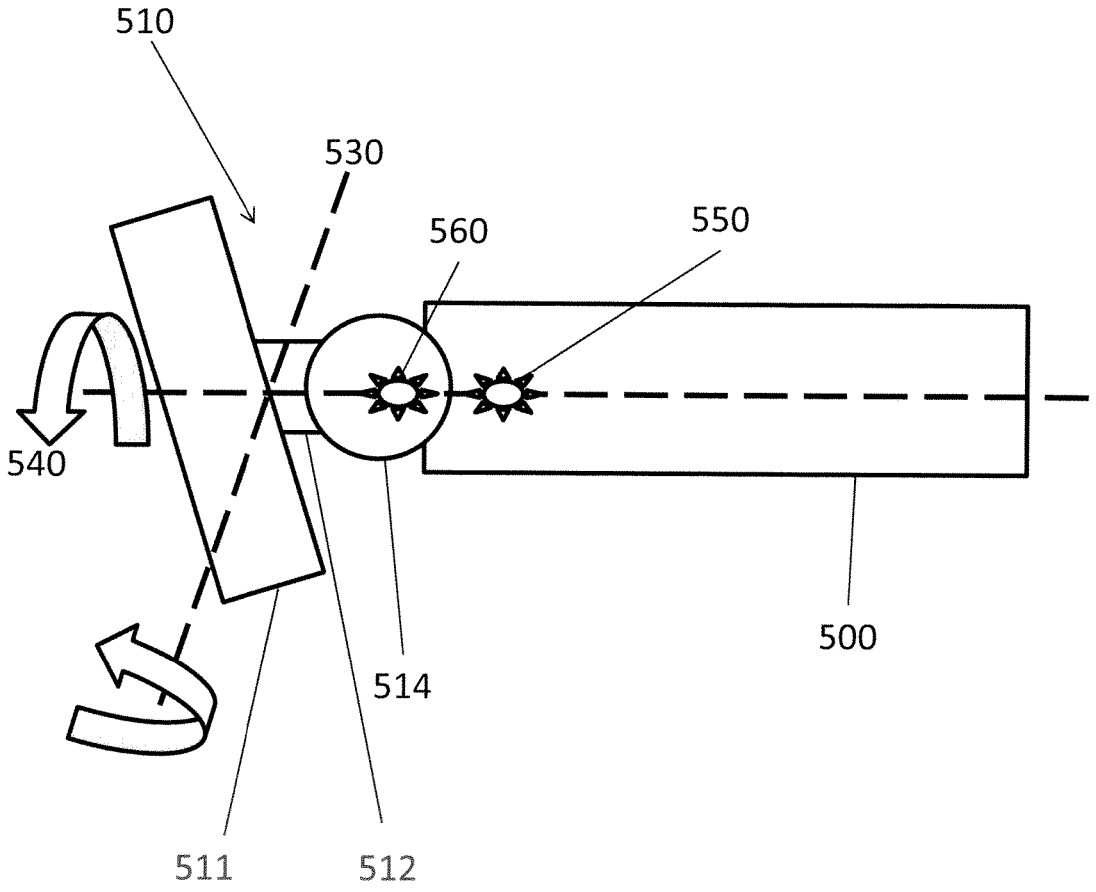
FIGS. 5A and 5B are schematic side views of a shaving razor according to yet another embodiment of the invention.
Figure 5B:
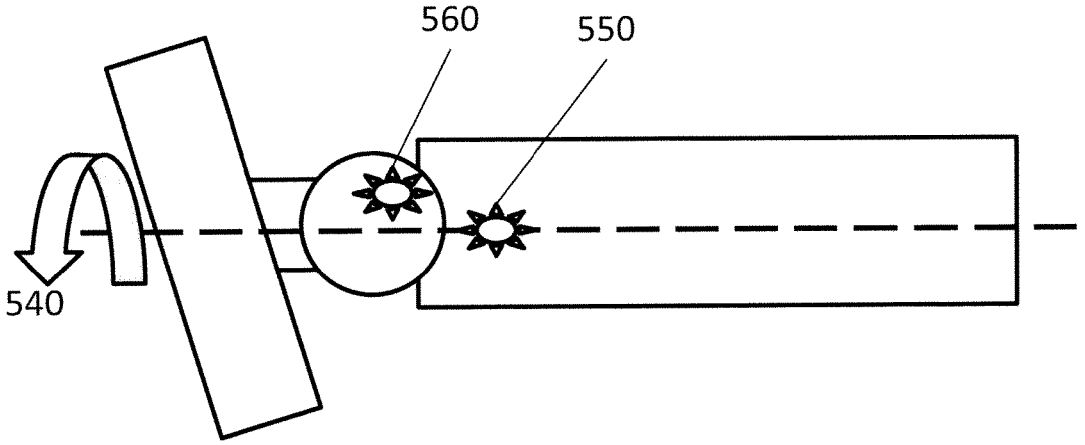

Referring now to FIGS. 5A and 5B, a shaving razor of the present invention comprises a first component 500 and a second component 510. In an embodiment, the first component 500 includes a handle and the second component 510 includes a razor cartridge, a housing for a razor cartridge 511, a first interconnect member 512, and a second interconnect member 514. The second component 510 includes at least one blade. The first interconnect member 512 is coupled to the housing for a razor cartridge 511 so as to allow the second component 510 to rotate about a first axis of rotation 530. In an embodiment, the first axis of rotation 530 is substantially parallel to the at least one blade and substantially perpendicular to a length of the first component 500. The second component 510 is configured to rotate relative to the first component 500 such that the second component 510 rotates about a second axis of rotation 540. In an embodiment, the second axis of rotation 540 is substantially perpendicular to the at least one blade and substantially parallel to the length of the first component 500. The first component 500 comprises a first indicia 550, such as one or more indicia, and the second component 510 comprises a second indicia 560, such as one or more indicia.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. Embodiments according to the invention may also combine elements or components of that are disclosed in general but not expressly exemplified in combination unless otherwise stated herein. It is therefore intended to cover in the appended claims all such changes and modifications that are within the scope of this invention.

What is claimed is:

1. A razor comprising:

a first component comprising a first indicia on a surface of the first component; and a second component configured to rotate relative to the first component about a first axis of rotation, the second component comprising at least one blade and a second indicia on a surface of the second component, the second component configured to rotate relative to the first component about a second axis of rotation, wherein the second axis of rotation and the first axis of rotation are non-coplanar, wherein the second component is in a preloaded neutral position when at rest such that the first indicia and the second indicia are in alignment at rest and out of alignment when the second component has been rotated about the first axis of rotation.

2. The razor of claim 1, wherein the second axis of rotation is substantially perpendicular to the first axis of rotation.

3. The razor of claim 1, wherein the first indicia is disposed near the second indicia.

4. The razor of claim 3, wherein the first indicia comprises a first apex and the second indicia comprises a second apex, the first apex is facing and aligned with the second apex when the second component is at rest.

5. The razor of claim 4, wherein at least one of the first indicia and the second indicia further comprises a gradient leading to at least one of the first apex and the second apex.

6. The razor of claim 1, wherein application of the first indicia to the first component is selected from the group consisting of painting, stamping, heat treating, molding, skiving, gluing, casting, cutting, and combinations thereof.

7. The razor of claim 6, wherein the first indicia is integrally formed with the first component.

8. The razor of claim 1, wherein application of the second indicia to the second component is selected from the group consisting of painting, stamping, heat treating, molding, skiving, gluing, casting, cutting, and combinations thereof.

9. The razor of claim 8, wherein the second indicia is integrally formed with the second component.

10. The razor of claim 1, wherein at least one of the first indicia and the second indicia has a shape selected from the group consisting of linear shapes, polygonal shapes, arcuate shapes, and combinations thereof.

11. The razor of claim 1, wherein the first indicia is a different shape than the second indicia.

12. The razor of claim 1, wherein the first indicia is a different size than the second indicia.

13. The razor of claim 1, wherein the first component is a handle.

14. The razor of claim 1, wherein the second component includes a housing for a razor cartridge.

* * * * *